US008434764B2

(12) United States Patent
Walker et al.

(10) Patent No.: US 8,434,764 B2
(45) Date of Patent: May 7, 2013

(54) SYSTEMS AND METHODS FOR OPERATING A CARD GAME

(75) Inventors: Jay S. Walker, Ridgefield, CT (US); James A. Jorasch, New York, NY (US); Robert C. Tedesco, Fairfield, CT (US); Michael W. Patterson, New York, NY (US)

(73) Assignee: IGT, Reno, NV (US)

( * ) Notice: Subject to any disclaimer, the term of this patent is extended or adjusted under 35 U.S.C. 154(b) by 365 days.

(21) Appl. No.: 11/575,368

(22) PCT Filed: Sep. 25, 2006

(86) PCT No.: PCT/US2006/037036

§ 371 (c)(1), (2), (4) Date: Mar. 15, 2007

(87) PCT Pub. No.: WO2008/039175

PCT Pub. Date: Apr. 3, 2008

(65) Prior Publication Data

US 2010/0252997 A1 Oct. 7, 2010

(51) Int. Cl.
*A63F 1/00* (2006.01)

(52) U.S. Cl.
USPC ..... 273/292

(58) Field of Classification Search ..... None
See application file for complete search history.

(56) References Cited

U.S. PATENT DOCUMENTS

| | | | | |
|---|---|---|---|---|
| 5,603,499 | A * | 2/1997 | Jagosz | 273/148 R |
| 5,732,949 | A | 3/1998 | Josephs | |
| 6,676,522 | B2 | 1/2004 | Rowe et al. | |
| 6,726,427 | B2 * | 4/2004 | Jarvis et al. | 273/292 |
| 6,869,074 | B2 * | 3/2005 | Miller | 273/292 |
| 7,156,734 | B1 * | 1/2007 | Walker et al. | 463/12 |
| 7,309,066 | B2 * | 12/2007 | Donaldson | 273/292 |
| 7,354,344 | B2 * | 4/2008 | Paulsen et al. | 463/20 |
| 7,419,162 | B2 | 9/2008 | Lancaster et al. | |
| 2006/0135238 | A1 | 6/2006 | Lancaster et al. | |
| 2007/0213113 | A1 * | 9/2007 | Dunaevsky et al. | 463/12 |
| 2008/0020815 | A1 | 1/2008 | Lancaster et al. | |
| 2008/0070674 | A1 | 3/2008 | Lancaster et al. | |
| 2008/0076500 | A1 | 3/2008 | Lancaster et al. | |

OTHER PUBLICATIONS

International Search Report for Application No. PCT/US2006/037036 dated Sep. 26, 2007.

Written Opinion for Application No. PCT/US2006/37036 dated Sep. 26, 2007.

* cited by examiner

*Primary Examiner* — Kurt Fernstrom
*Assistant Examiner* — Dolores Collins
(74) *Attorney, Agent, or Firm* — Neal, Gerber & Eisenberg LLP

(57) ABSTRACT

A gaming device presents multiple hands of the game played on the gaming device as part of a single round of game play. The player wagers on whether the composite set of the multiple hands has certain attributes. If the attributes are present in the composite set, the player receives a winning outcome and receives a benefit. In a particularly contemplated implementation, the game is blackjack, and the attributes are based on the number and type of cards as well as the manner in which individual hands beat the dealer and by how many points.

10 Claims, 11 Drawing Sheets

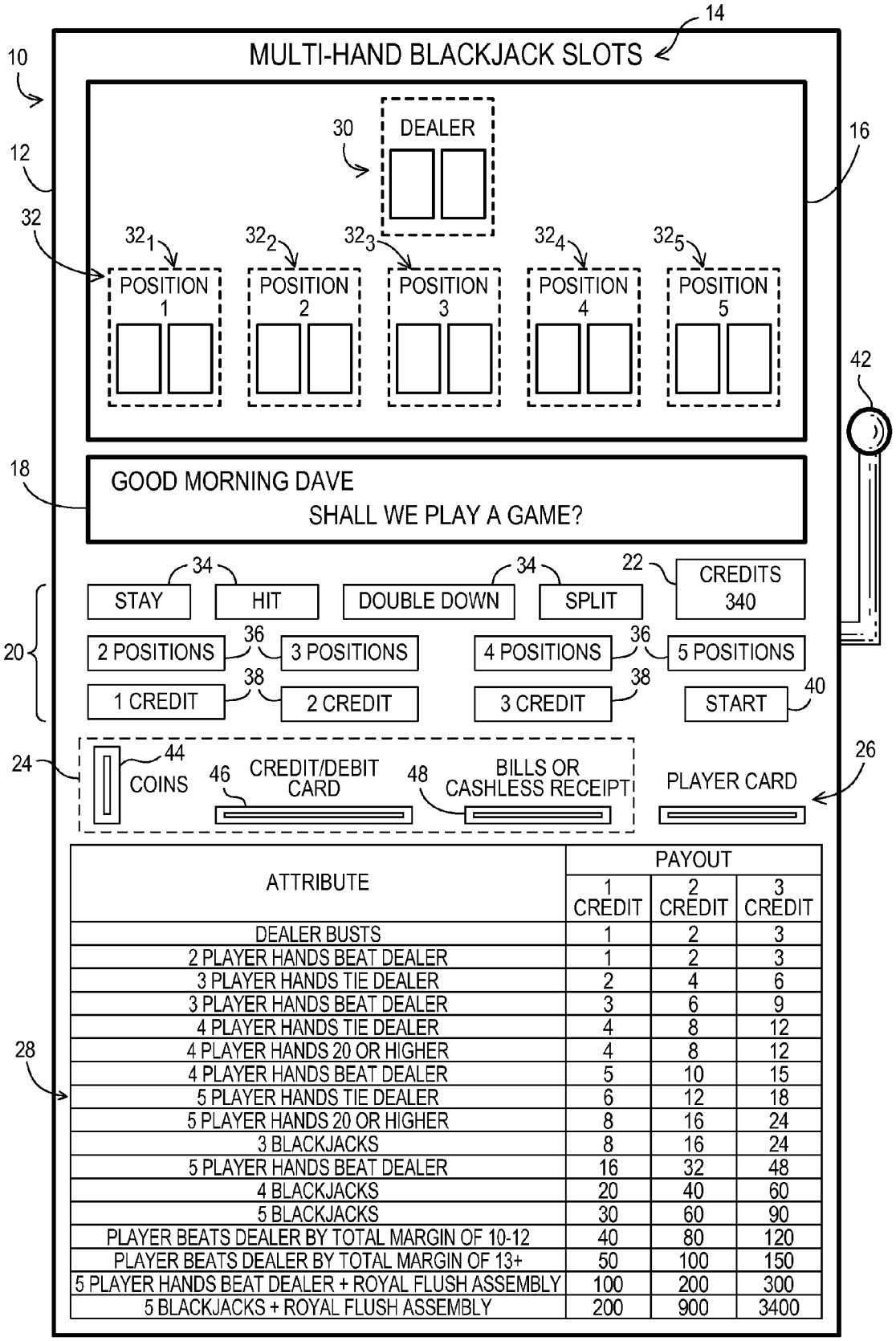

28

| ATTRIBUTE | PAYOUT | | |
|---|---|---|---|
| | 1 CREDIT | 2 CREDIT | 3 CREDIT |
| DEALER BUSTS | 1 | 2 | 3 |
| 2 PLAYER HANDS BEAT DEALER | 1 | 2 | 3 |
| 3 PLAYER HANDS TIE DEALER | 2 | 4 | 6 |
| 3 PLAYER HANDS BEAT DEALER | 3 | 6 | 9 |
| 4 PLAYER HANDS TIE DEALER | 4 | 8 | 12 |
| 4 PLAYER HANDS 20 OR HIGHER | 4 | 8 | 12 |
| 4 PLAYER HANDS BEAT DEALER | 5 | 10 | 15 |
| 5 PLAYER HANDS TIE DEALER | 6 | 12 | 18 |
| 5 PLAYER HANDS 20 OR HIGHER | 8 | 16 | 24 |
| 3 BLACKJACKS | 8 | 16 | 24 |
| 5 PLAYER HANDS BEAT DEALER | 16 | 32 | 48 |
| 4 BLACKJACKS | 20 | 40 | 60 |
| 5 BLACKJACKS | 30 | 60 | 90 |
| PLAYER BEATS DEALER BY TOTAL MARGIN OF 10-12 | 40 | 80 | 120 |
| PLAYER BEATS DEALER BY TOTAL MARGIN OF 13+ | 50 | 100 | 150 |
| 5 PLAYER HANDS BEAT DEALER + ROYAL FLUSH ASSEMBLY | 100 | 200 | 300 |
| 5 BLACKJACKS + ROYAL FLUSH ASSEMBLY | 200 | 900 | 3400 |

FIG. 1

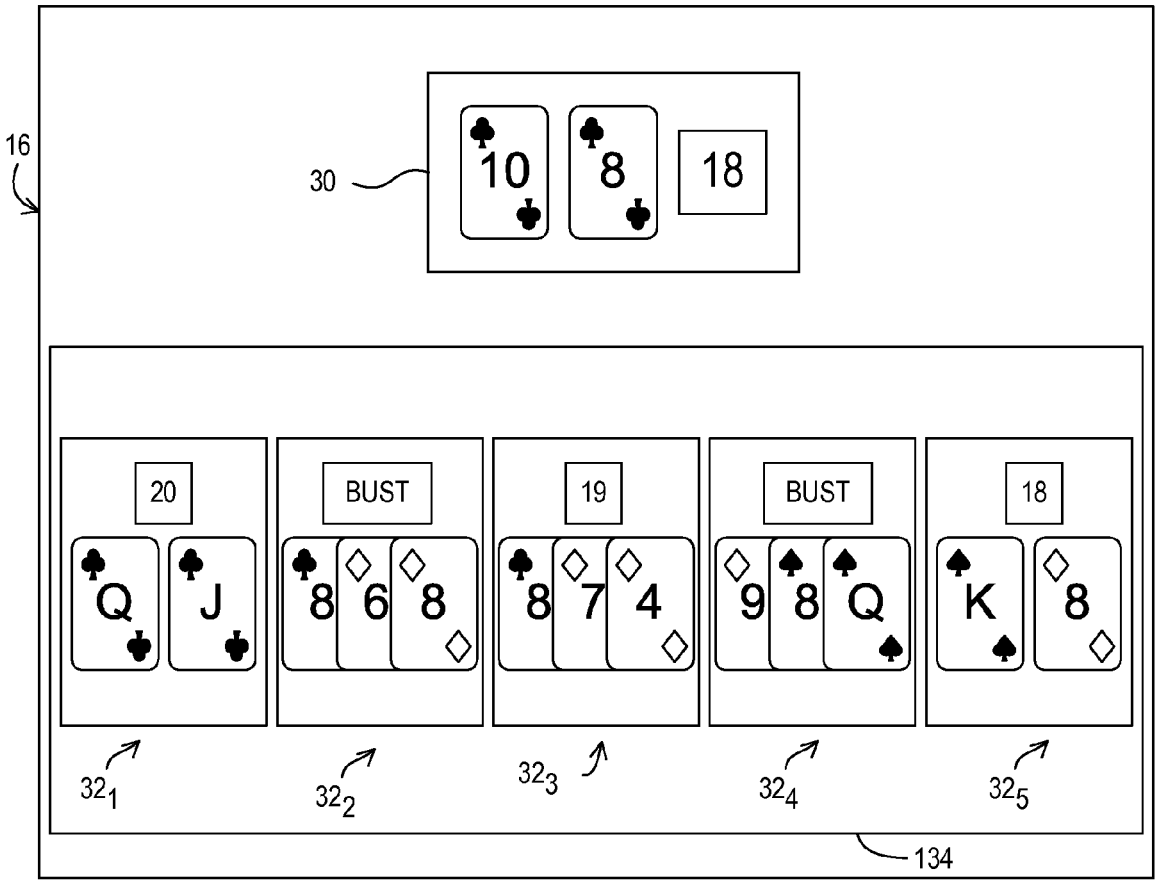
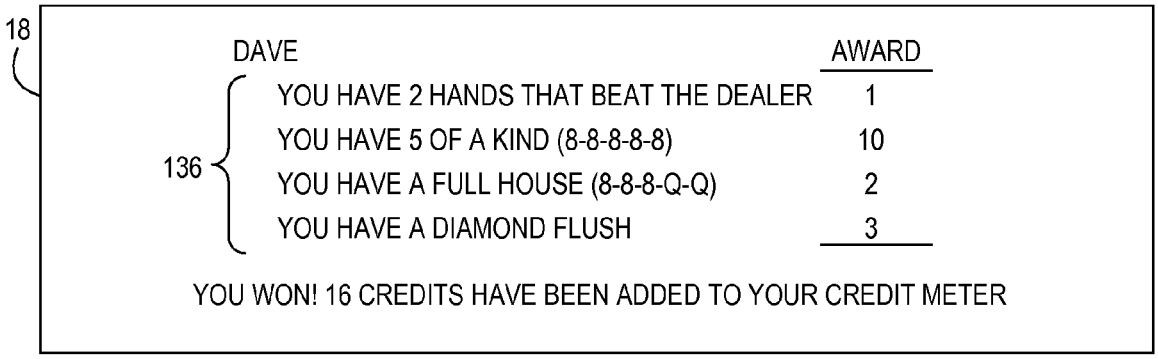
FIG. 9

4+ DECKS, DEALER HITS ON SOFT 17

| YOUR HAND | DEALER'S CARD | | | | | | | | | |
|---|---|---|---|---|---|---|---|---|---|---|
| | 2 | 3 | 4 | 5 | 6 | 7 | 8 | 9 | 10 | A |
| 8 | H | H | H | H | H | H | H | H | H | H |
| 9 | H | D | D | D | D | H | H | H | H | H |
| 10 | D | D | D | D | D | D | D | D | H | H |
| 11 | D | D | D | D | D | D | D | D | D | D |
| 12 | H | H | S | S | S | H | H | H | H | H |
| 13 | S | S | S | S | S | H | H | H | H | H |
| 14 | S | S | S | S | S | H | H | H | H | H |
| 15 | S | S | S | S | S | H | H | H | H | H |
| 16 | S | S | S | S | S | H | H | H | H | H |
| 17 | S | S | S | S | S | S | S | S | S | S |
| A,2 | H | H | H | D | D | H | H | H | H | H |
| A,3 | H | H | H | D | D | H | H | H | H | H |
| A,4 | H | H | D | D | D | H | H | H | H | H |
| A,5 | H | H | D | D | D | H | H | H | H | H |
| A,6 | H | D | D | D | D | H | H | H | H | H |
| A,7 | D | D | D | D | D | S | S | H | H | H |
| A,8 | S | S | S | S | D | S | S | S | S | S |
| 2,2 | H/P | H/P | P | P | P | P | H | H | H | H |
| 3,3 | H/P | H/P | P | P | P | P | H | H | H | H |
| 4,4 | H | H | H | H/P | H/P | H | H | H | H | H |
| 5,5 | D | D | D | D | D | D | D | D | H | H |
| 6,6 | H/P | P | P | P | P | H | H | H | H | H |
| 7,7 | P | P | P | P | P | P | H | H | H | H |
| 8,8 | P | P | P | P | P | P | P | P | P | P |
| 9,9 | P | P | P | P | P | S | P | P | S | S |
| 10,10 | S | S | S | S | S | S | S | S | S | S |
| A,A | P | P | P | P | P | P | P | P | P | P |

| | |
|---|---|
| H | HIT |
| S | STAND |
| D | DOUBLE |
| P | SPLIT |
| H/P | SPLIT IF DOUBLE AFTER SPLIT, ELSE HIT |

FIG. 10

SYSTEMS AND METHODS FOR OPERATING A CARD GAME

RELATED APPLICATIONS

The present application claims the benefit of priority of PCT/US2006/37036, filed Sep. 25, 2006, entitled "MULTIPLE POSITION SINGLE ROUND GAMING SLOT MACHINE AND METHOD", which is incorporated by reference herein in its entirety.

FIELD OF THE INVENTION

The present invention relates to multi-hand gaming opportunities and, in a particularly contemplated embodiment, relates to multi-hand blackjack games.

BRIEF DESCRIPTION OF THE DRAWINGS

FIG. 1 illustrates a front elevational view of a gaming device suitable for use with some embodiments of the present invention;

FIG. 9 illustrates a third exemplary screen shot of a portion of the methodology of FIG. 6;

FIG. 10 illustrates an exemplary "perfect play" strategy card; and

DETAILED DESCRIPTION OF THE INVENTION

Figure 2:
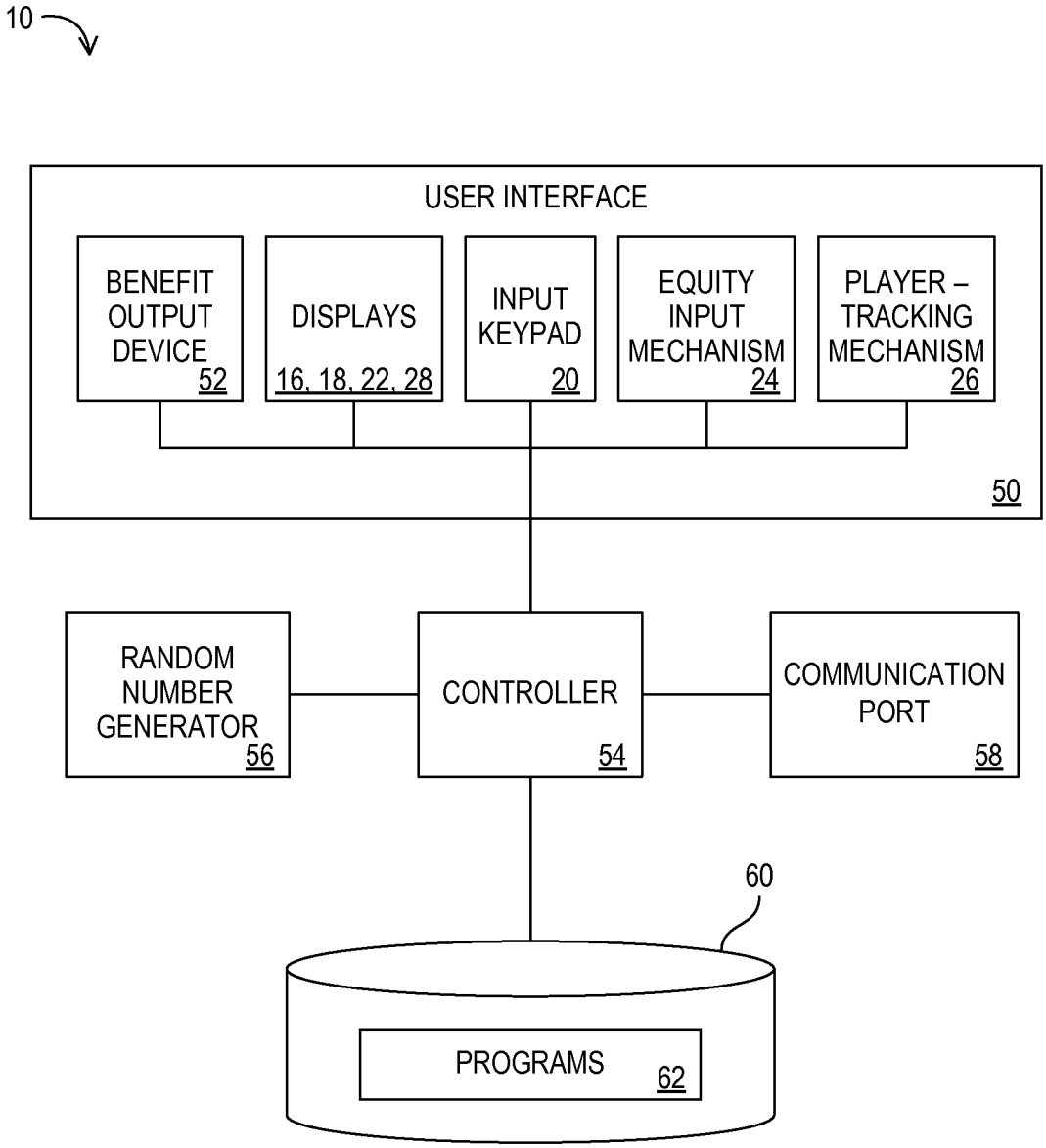
FIG. 2 illustrates a block diagram schematic of the gaming device of FIG. 1.

Blackjack is one of the most popular table games in casinos today. Its popularity is based in part on the relatively easy to understand rules and the fact that perfect play reduces the house edge to approximately 0.5% (or less depending on the number of decks used and whether the table uses Las Vegas, Atlantic City, or other variant rules). While gaming establishments are generally profitable, operators are seemingly always looking for new ways to increase revenue.

Embodiments of the present disclosure seek to leverage the popularity of blackjack by providing multiple blackjack hands to a single player during a round of game play at a gaming device or table. The multiple hands are amalgamated into a composite set of cards. The player wagers on whether or not the set containing the multiple blackjack hands has certain attributes or characteristics. The attributes or characteristics of the set are compared to predefined thresholds to determine an outcome (winning or losing), and, if appropriate, a benefit is awarded to the player according to a paytable.

In a particular exemplary embodiment, for a single round of play, a player selects a number of blackjack hands that are dealt to the player and places a wager as a multiple of a unit of wager. The hands are dealt to the player, and a hand is dealt to the dealer. The player may make strategy decisions for each hand (stay, hit, double down, and the like) to create the set containing the multiple blackjack hands. The attributes of the set containing the multiple blackjack hands are then evaluated and compared to a paytable. For example, if the set containing the multiple blackjack hands contains more than five hearts, a benefit may be provided. The types of attributes and thresholds associated with the attributes may be varied as practical or desired while maintaining a suitable house edge. As the player has to make several decisions, the player may feel more involved than during the course of ordinary slot machine play, which in turn may cause the player to play for longer periods of time.

To facilitate understanding, an overview of appropriate hardware and software components may be implemented is provided with respect to FIGS. 1-5. The discussion of the particularly contemplated details of various embodiments begins below with reference to FIG. 6.

FIG. 1 illustrates a front elevational view of a gaming device 10, which is, as illustrated, a multi-hand blackjack slot machine that may be used in accordance with some embodiments. The gaming device 10 includes a housing 12 boasting game name indicia 14 and a primary display 16 on which the game action is presented. A secondary display 18 presents images and text to provide supplemental information or instructions to the player as practical or desired.

An input keypad 20 includes a plurality of buttons through which the player may provide input to the gaming device 10. A credit meter 22 displays a current total of credits available to the player. Credits may be established by the player through the use of an equity input mechanism 24 or through game play as will be further described herein.

A player-tracking mechanism 26 may be used to identify a player at the gaming device 10, which, in turn, may allow messages on the secondary display 18 to be personalized, comp points posted to the player profile, and the like. Belly glass paytable display 28 provides a listing of the paytable used by the gaming device 10. Collectively, the displays 16, 18, 28, input keypad 20, credit meter 22, equity input mechanism 24 and player-tracking mechanism 26 may be thought of as a user interface 50 (see FIG. 2) for the gaming device.

More particularly, the primary display 16 presents, in this exemplary embodiment, a dealer position 30 and one or more player positions 32 (denoted $\mathbf{32}_1$-$\mathbf{32}_5$ herein for the five player positions illustrated, although fewer or more positions may be used as practical or desired). When not actively conducting game play, the gaming device 10 may present an attraction screen or video clip designed to draw attention to the gaming device 10 and entice a player to begin game play on the gaming device 10.

As illustrated, the dealer position 30 and each player position 32 include indicia representative of the two cards dealt to the position at the beginning of blackjack game play. During game play, animations of cards being dealt may be presented and the cards then displayed on the card indicia. In an exemplary embodiment, one of the cards at the dealer position 30 is initially dealt face down so that the player does not know what that card is. As the player requests additional cards through a "hit" command, more animations may be provided to present the additional cards, and the additional cards may be added to the player position 32 in any appropriate manner. Once the player has resolved each hand at each active player position 32, the face down dealer card may be flipped, and cards may be added to the dealer position according to well established rules (e.g., a dealer always hits on a soft seventeen or less). More detail on conducting game play is provided below.

The primary display 16, secondary display 18, the credit meter 22, and/or the belly glass paytable display 28 may be an LED, LCD, CRT or other appropriate display type as practical or desired. In an alternate embodiment, the belly glass paytable display 28 is a static display and is merely indicia painted, etched, or otherwise affixed to a glass panel.

Input keypad 20 includes play command buttons 34, which for blackjack may include commands such as "stay", "hit", "double down", and "split", each of which interoperates during game play according to the well understood rules of blackjack. While not shown, a "surrender" button may be provided if practical or desired. Indicia providing a textual or visual clue as to the play command may be presented on the buttons 34 as is well understood.

Input keypad 20 may further include a plurality of position selection buttons 36 that indicate to the gaming device 10 how many player positions 32 (from amongst the total number of available player positions 32 provided on the primary display 16) the player wishes to activate. In the exemplary embodiment, since there are five player positions 32, the player may select from between two and five player positions by pressing the appropriate position selection button 36. Indicia providing a textual or visual clue as to the number of positions associated with the button 36 may be presented on the button 36 as is well understood.

Input keypad 20 may further include credit wager buttons 38. As defined herein in the section entitled Rules of Interpretation presented below, the gaming device 10 operates using units of wager. Each credit herein corresponds to a unit of wager. The player may select how many units of wager are to be bet by pressing the corresponding credit wager button 38. In this exemplary embodiment, one through three units of wager may be bet by the player. In other embodiments, more or fractional units of wager may be bet by the player as practical or desired. Note that input keypad 20 may be actual mechanical buttons or incorporated into a touch screen display as practical or desired.

Input keypad 20 may still further include a start mechanism. In a first embodiment, the start mechanism is a start button 40. In a second embodiment, the start mechanism is a handle 42. While not strictly a button, the handle 42 is, for the purposes of the present disclosure, defined to be part of an input keypad. The player initiates a game start by pressing the start button 40 or pulling the handle 42. Other start mechanisms may be used as practical or desired.

The equity input mechanism 24 may include a coin acceptor 44, a magnetic card reader 46, a paper acceptor 48 and/or the like. Magnetic card reader 46 may accept credit, debit or other form of card including a smart card or the like. The paper acceptor 48 may accept bills in appropriate denominations and/or be a cashless gaming receipt acceptor. Still further the paper acceptor 48 may print cashless gaming receipts. Alternatively benefits may be output through a coin hopper (not shown) or through a dedicated cashless gaming receipt printer (also not shown) as is well understood in the slot industry. While not shown, the equity input mechanism 24 could include a radio frequency identification (RFID) interrogator that interoperates with a player-controlled transponder (e.g., incorporated into a key fob or the like). The interrogator could retrieve an account number (e.g., a credit card account, a bank account, or the like) from the transponder and establish equity therethrough. As yet another alternative, the player may use a cellular phone (or other mobile terminal) and call a number displayed on the gaming device 10. The gaming device 10 may then bill the cellular phone account of the player. As yet another option, the mobile terminal may communicate with the gaming device 10 through some other protocol (e.g., BLUETOOTH™ or WI-FI™) and provide account information to the gaming device 10 such that the account may be billed as practical or desired. A dongle with an electronic wallet stored thereon, or other similar structure could be used in conjunction with an appropriate dongle port. Still other mechanisms for establishing equity may be used if practical or desired. In place of providing a benefit through the coin hopper or a cashless gaming receipt, funds may be credited to an account that was used to establish equity (e.g., a credit applied to a cellular phone account, direct deposit to a bank, and the like) or other account associated with the player (e.g., such as an account associated with a player-tracking profile).

The player-tracking mechanism 26 may be a magnetic card reader into which the player inserts a magnetic stripe player-tracking card. While illustrated as a magnetic card reader, it should be appreciated that the player-tracking mechanism 26 could be a smart card reader, a bar code reader, a dongle port, or other mechanism such as a wireless interrogator that interrogates a RFID device such as a transponder positioned in a key chain fob or the like. In still another embodiment, the player-tracking mechanism 26 may be a biometric input such as a fingerprint reader, a retinal scanner, or the like. Such inputs may be accompanied by a keypad for PIN entry if practical or desired. Acknowledgement of use of a player-tracking device may be made on the secondary display 18 or other location as practical or desired.

A block diagram of the gaming device 10 is illustrated in FIG. 2. In particular, the gaming device 10 includes the user interface 50, which includes the displays 16, 18, 22, 28, the input keypad 20, the equity input mechanism 24, the player-tracking mechanism 26, and a benefit output device 52 (e.g., the coin hopper or cashless receipt printer). The user interface 50 is operatively coupled to a controller 54. The controller 54 may further be operatively coupled to a random number generator 56 and a communication port 58. Memory 60 with programs 62 stored therein is further operatively associated with the controller 54. The elements of the gaming device 10 may communicate over a wirebased bus (not shown explicitly) or wirelessly as practical or desired. The controller 54 with memory 60 and the programs 62 is a control system as that term is defined in the Rules of Interpretation.

Note that while the user interface 50 has been described in terms of discrete buttons and displays, it is possible, as alluded to above, that the buttons of the input keypad 20 may be incorporated into one or more displays through the use of a touch screen. Extending this concept, the touch screen may include menus and active buttons from which a player may select various options relating to her gaming experience. An exemplary option may be supplemental audio played through speakers on the gaming device 10. This option may be selected from a menu. Such menus may be WINDOWS® style drop down menus that appear when a player touches a particular portion of the touch screen, selectively enabled through the actions of the player, or otherwise made available as practical or desired. Once the menu appears, the touch screen may make the menu active such that a player may make a selection from the menu by touching the area of the screen on which the option appears. While a WINDOWS® style menu option is possible, other presentations are also possible. Instead of audio, video could also be selected through such menus and then presented on one or more of the displays. As is readily understood, such a touch screen may require a touch screen controller with the menus stored in appropriate memory devices (e.g., memory 60) associated with the gaming device 10. Likewise, the content that is selected from such menus must be available either locally or remotely so that the gaming device 10 may present such content. In some embodiments, the display of such menus may preempt the display of other information. For example, in one embodiment, the menus may appear on a display 28 and, when the menus are active, the paytable illustrated in FIG. 1 may be obscured by the menus. Other arrangements are also contemplated.

The controller 54 may be positioned within the housing 12 of the gaming device 10. Memory 60 may also be positioned within the housing 12 and may be a computer readable medium as that term is defined in the Rules of Interpretation. The software programs 62 include instructions for making the controller 54 operate. The software programs 62 may be stored in a compressed, uncompiled, and/or encrypted format. The software programs 62 may include program elements that are necessary for operation of the controller 54 such as an operating system, a database management system, device drivers, and the like. The software programs 62 may be uploaded into the memory 60 through any appropriate mechanism such as installation from a floppy, CD, or DVD drive, downloaded from a network through communication port 58, or other mechanism as is well understood. While not explicitly illustrated, memory 60 may store a probability database and/or a payout database. The book "Winning At Slot Machines" by Jim Regan (Carol Publishing Group Edition, 1997) illustrates examples of payout and probability tables and how they may be derived. The entirety of this book is incorporated by reference herein.

The payout database may be a paytable database containing the information presented in the display 28 in such a manner that hands at the player positions 32 may be compared thereto and a benefit for the player determined. Such a paytable database may include an attribute entry defining an attribute, a threshold for the attribute above which the player has qualified for a winning outcome, and a benefit entry which may include a number of credits, comp points, or other value to be awarded to the player. Other arrangements are also possible. Note that the benefit may be a cash value benefit, a comp point, a free game start, an element such as a token redeemable for a free game start, a bonus game start, access to an improved paytable, access to some form of premium play, a ticket to a show, a ticket for a discount at a restaurant, or the like. note that the premium play may be selected from a menu, which may include forms of insurance, improved paytables, reduced wager requirements, and the like.

The random number generator 56 (as well as any other random number generator described herein), in accordance with at least one embodiment, may generate data representing random or pseudo-random values (referred to as "random numbers" herein). The random number generator 56 may generate a random number every predetermined unit of time (e.g., every second) or in response to an initiation of a game on the gaming device 10. In the former embodiment, the generated random numbers may be used as they are generated (e.g., the random number generated at substantially the time of game initiation is used for that game) and/or stored for future use in the memory 60.

The random number generator 56, as used herein, may be embodied as a processor separate from but working in cooperation with controller 54. Alternatively, the random number generator 56 may be embodied as an algorithm, program component, or software program 62 stored in the memory 60 or other device and used to generate a random number.

Note that, although the generation or obtainment of a random number is described herein as involving the random number generator 56, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

The communication port 58 may connect the gaming device 10 to a communication network 64 (FIG. 3) through any appropriate communication medium and protocol. An exemplary communication port 58 is an Ethernet port that connects the gaming device 10 to an internet protocol (IP) network.

While not illustrated, some of the components of the gaming device 10 may be embodied as a peripheral device that is operatively associated with the gaming device 10. Such peripheral devices may be mounted on or positioned proximate to the housing 12 of the gaming device 10 as practical or desired. Such peripheral devices may be particularly useful in retrofitting functionality into the gaming device 10. Alternatively, a retrofit package may be assembled including new belly glass and an EEPROM chip that is installed in the memory 60 with the new programs 62 that enable the functionality of one or more embodiments.

Figure 3:
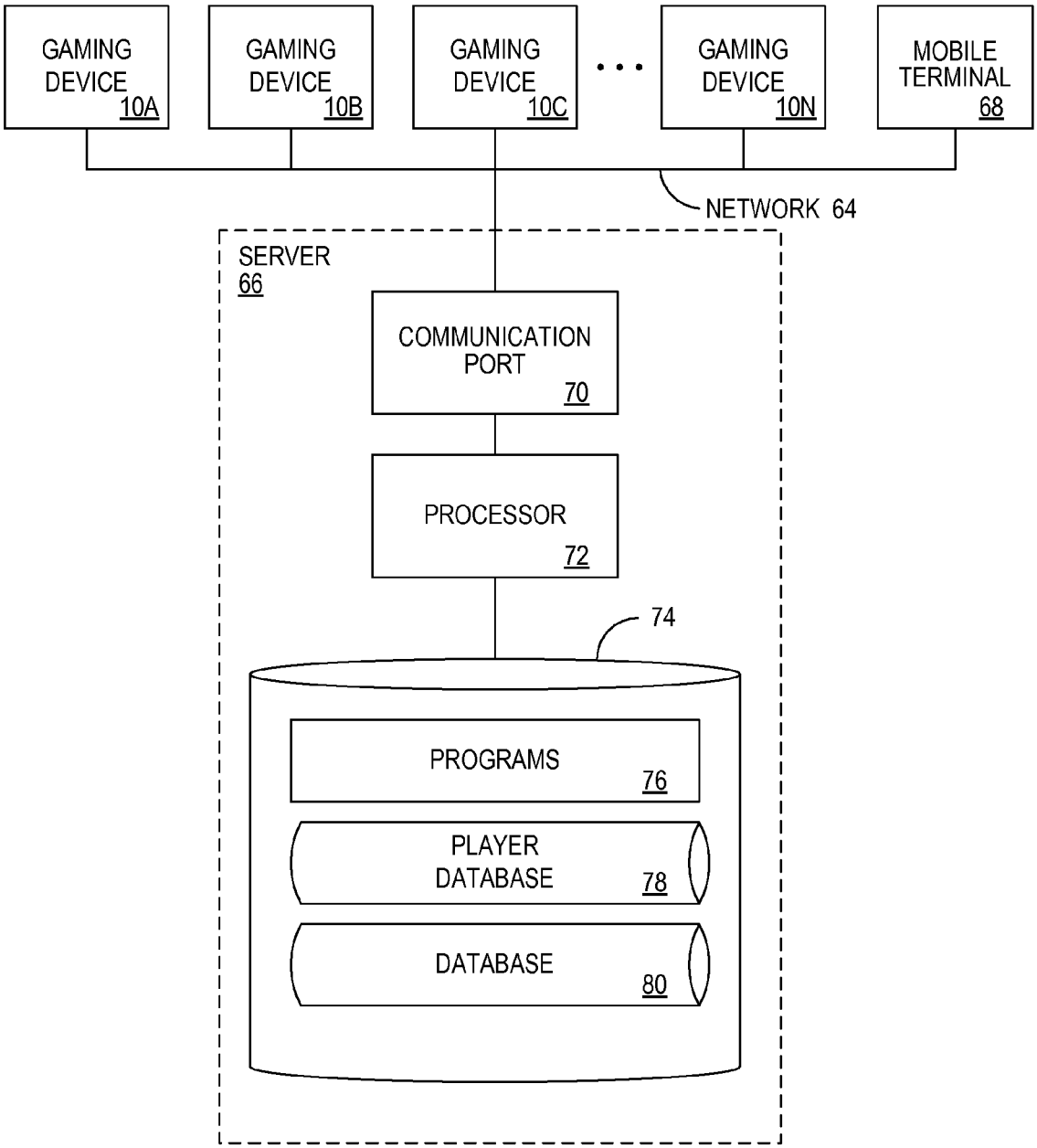
FIG. 3 illustrates a server based gaming environment suitable for use with some embodiments of the present invention.

The gaming device 10 may be a stand-alone device or it may be connected to the network 64 as better illustrated in FIG. 3. For example, gaming devices 10A-10N may be connected through the network 64 to a server 66. Additionally a mobile terminal 68 may be connected to the network 64. More information on the mobile terminal 68 and its operation within the network 64 is provided below with reference to FIG. 4. Network 64 is a network as that term is defined in the Rules of Interpretation.

The server 66 may include a communication port 70 adapted to couple operatively the server 66 to the network 64 and a processor 72. The processor 72 may be operatively coupled to memory 74 with programs 76 stored thereon. A player database 78 and other databases 80 may further be stored on the memory 74 as practical or desired. The processor 72 coupled with the programs 76 is a control system as that term is defined in the Rules of Interpretation.

The server 66 may perform some of the functionality previously attributed to the gaming device 10. That is, the gaming devices 10 may act as client devices for the server 66 with most of the processing and decision making occurring on the server 66. In such an instance, the processor 72 is operatively coupled to the user interface 50 through the network 64 and acts as the control system for the gaming device 10. The memory 74 may store additional databases, including, but not limited to: a game database that stores information regarding one or more games playable on and/or downloadable to one or gaming devices 10, and a scheduling and/or configuration database useful for determining which games are to be made available on which gaming devices 10 at what times. In other embodiments, some or all of these functions may be handled by a device distinct from the server 66, but remotely positioned relative to the gaming devices 10.

In place of the payout and probability databases being present in the gaming devices 10, such databases and/or data may instead be stored in the databases 80 of the memory 78.

Likewise, the databases may be distributed and/or duplicated between various devices within the network 64.

The programs 76 may allow the server 66 to track gambling, gaming, or other activity performed at the gaming device 10, track gaming or other activities of individual players, instruct a gaming device 10 to perform one or more functions (e.g., output a message to a player, interrupt play, or the like), assign or otherwise determine a unique identifier for a player, and/or control access to stored funds and/or a credit line. In some embodiments the server 66 may be operable to configure a gaming device 10 remotely, update software stored on a gaming device 10, and/or download software or software components to a gaming device 10. For example, the server 66 may be operable to apply a hot fix to software stored on a gaming device 10, modify a payout and/or probability table stored on a gaming device 10, and/or transmit a new version of software and/or a software component to a gaming device 10. The server 66 may be programmed to perform any or all of the above functions as practical or desired and may do so based on, for example, an occurrence of an event (e.g., a scheduled event), receiving an indication from authorized gaming establishment personnel, an authorized third party (e.g., a regulator) and/or receiving a request from a player. In other embodiments, some or all of these functions may be handled by a device distinct from the server 66.

While the previous paragraph describes the server 66 configuring the gaming device 10, it is also possible that the server 66 stores games thereon, and these games are requested from the gaming device 10. The gaming device 10 may be programmed to check periodically if updates are available, and, if an update is available, download and install the update. Alternatively, the gaming device 10 may check on occurrence of an event, an indication from authorized gaming establishment personnel, an indication from an authorized third party, or the like. It is particularly contemplated that the gaming device 10 may be a thin client controlled by the server 66, although such is not required for operation.

Figure 4:
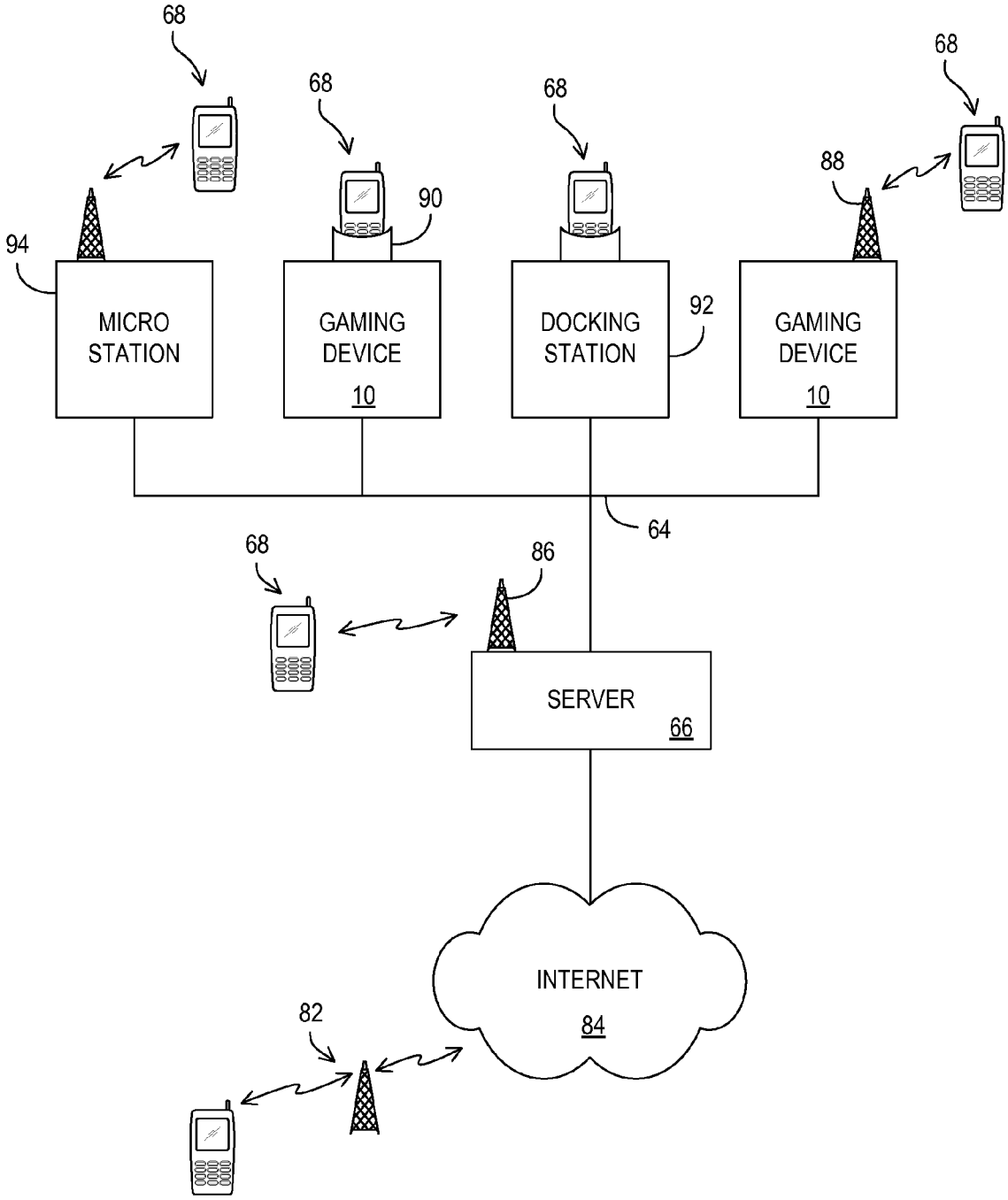
FIG. 4 illustrates exemplary techniques through which a mobile terminal may be networked into a communication system so as to implement one or more embodiments of the present invention.

In some embodiments, game play may be conducted on a mobile terminal 68 instead of a gaming device 10. FIG. 4 illustrates a variety of techniques through which the mobile terminal 68 may be so used. The illustrated techniques are intended to be exemplary and non-limiting. The mobile terminal 68 may be a cellular telephone, a personal digital assistant (such as a PALM® or BLACKBERRY™ device), a two way pager, a portable computer, a personal computer, a handheld gaming device (such as a wireless device marketed by DIAMOND I, INC.), or the like as practical or desired. In short, the mobile terminal 68 may be a device dedicated to gambling or a multipurpose device such as a cellular phone on which games may be played as practical or desired. The mobile terminal 68 includes a user interface including a keypad, microphone, speaker, and display. The mobile terminal 68 further includes a controller or processor with corresponding software stored in a local memory that acts as a control system as that term is defined in the Rules of Interpretation. Alternatively, the user interface of the mobile terminal 68 may be controlled by a remotely positioned control system such as the processor 72.

In one embodiment, the mobile terminal 68 may communicate through a wireless network 82 (e.g., such as the public land mobile network (PLMN)) to the internet 84, and through the internet 84 to an online casino server (not shown explicitly) or other server 66. In such an embodiment, the mobile terminal 68 may be equipped with a web browser (e.g., FIREFOX, MOZILLA, NETSCAPE NAVIGATOR, INTERNET EXPLORER, etc.) to interoperate with the online casino. While the internet 84 is contemplated, the public switched telephone network (PSTN) or other communication network may be used in place thereof as practical or desired. Alternatively, the mobile terminal 68 may download the game from such a server and the game may be played locally.

As yet another option, the mobile terminal 68 may instead communicate with elements of the network 64. In one embodiment, the mobile terminal 68 communicates with the server 66 through an antenna 86 coupled to the server 66 using an appropriate wireless protocol. In a second embodiment (not shown), the mobile terminal 68 may dock directly with the server 66 using appropriate docking technology. Note that this embodiment may require appropriate security and firewalls since the player will have essentially direct access to the server 66. In another embodiment, the mobile terminal 68 may communicate with a gaming device 10 through an antenna 88. Note that the antenna 88 may be coupled to the gaming device 10 through a peripheral device. In still another embodiment, the mobile terminal 68 may dock with the gaming device 10 through a docking cradle 90. Again, the docking cradle 90 may be incorporated into a peripheral device. In yet another embodiment, a dedicated docking station 92 may be provided, and the mobile terminal 68 may be coupled to the network 64 through the docking station 92. In yet another embodiment, a cellular microstation 94 may be communicatively coupled to the network 64 and the mobile terminal 68 may interoperate with the microstation 94. Other arrangements are also contemplated.

Instead of conducting game play on the mobile terminal 68, the mobile terminal 68 may form part of a user interface. For example, a player may use the display 16 of a gaming device 10, but issue commands related to game play through the mobile terminal 68. Again, the mobile terminal 68 may communicate with the gaming device 10 using any appropriate mechanism.

Figure 5:
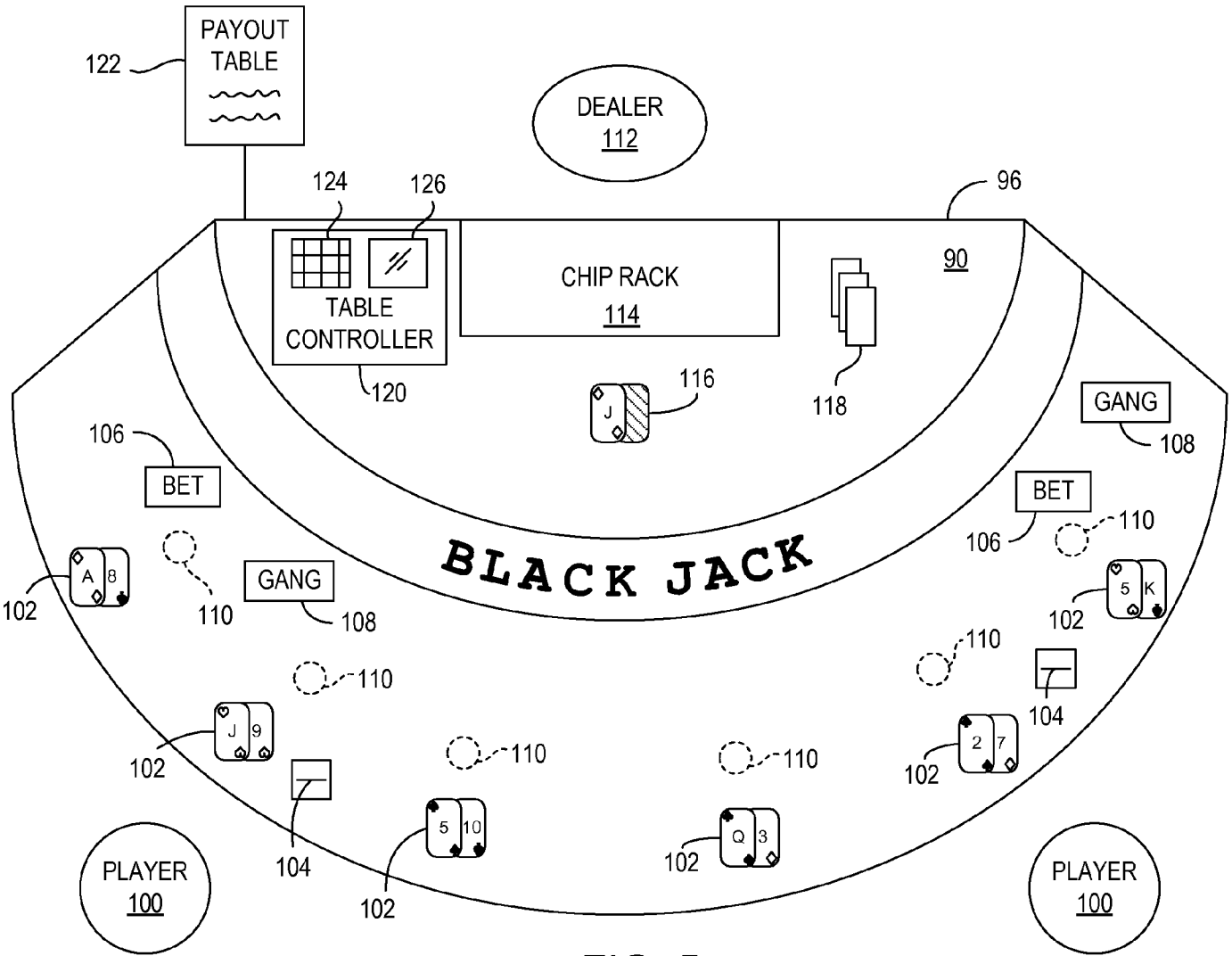
FIG. 5 illustrates a tabletop gaming station suitable for use with some embodiments of the present invention.

While the above discussion focuses on the possibility that the gaming device 10 is an electromechanical gaming device, other embodiments are not so limited. For example, certain embodiments may be implemented as a tabletop game using real cards as illustrated in FIG. 5. In particular, a table 96 may include a planar surface 98 on which players 100 may play at respective player stations. The player station may include a plurality of hand locations 102, a player-tracking mechanism 104, a bet location 106, an optional buddy bet location 108 (denoted "gang" in FIG. 5), and an optional individual hand wager location 110. Likewise, a dealer 112 may have a dealer station with a chip rack 114, a dealer hand location 116, a card shoe 118, a table controller 120, and a payout table display 122.

In use, the player 100 approaches the table 96 and places a unit of wager at bet location 106 using one or more chips. The dealer 112 deals cards from the shoe 118 to each hand location 102 and the dealer hand location 116 much like a dealer deals a normal blackjack game. If the optional gang up on the dealer bet option is available, the player may make this wager by placing a unit of wager at buddy bet location 108. Much like a side bet in Caribbean Stud, the gang up on the dealer bet option may have a fixed value (e.g., $1). Likewise, if the optional individual hand wager option is available, the player 100 may place one or more chips representing units of wager at the optional individual hand wager locations 110 depending on which hands that player 100 wishes to play individually. More details are provided for these differing bets and resolving these bets below. The player-tracking mechanism 104 may be analogous to player-tracking mechanism 26 described above and serve the same function.

The chip rack 114 holds the bank, receiving chips from losing wagers and paying chips for winning wagers as is well known. The shoe 118 may be an automatic shuffler and hold one or more decks of cards as practical or desired. As several such shoes are commercially available, these shoes are well understood in the industry. Note that some shoes do not have a shuffler, but such tables may have a separate shuffler that shuffles the cards before they are placed in the shoe 118. Again, such devices are well understood in the industry. The table controller 120 may include a keyboard 124 and a display 126 as well as a camera, microphone, and/or speakers. The dealer 112 may provide a running commentary through the microphone to memorialize game play; the camera may capture images associated with game play as it is conducted; and/or the dealer 112 may type in summaries of each round of game play as practical or desired. Not all aspects of game play need be recorded by the table controller 120, and it should be appreciated that the table controller 120 is optional. However, tracking players for player reward programs and detecting fraud is facilitated through such a table controller 120. The payout table display 122 may provide the same information that is present on the belly glass display 28 of the gaming device 10.

Figure 6:
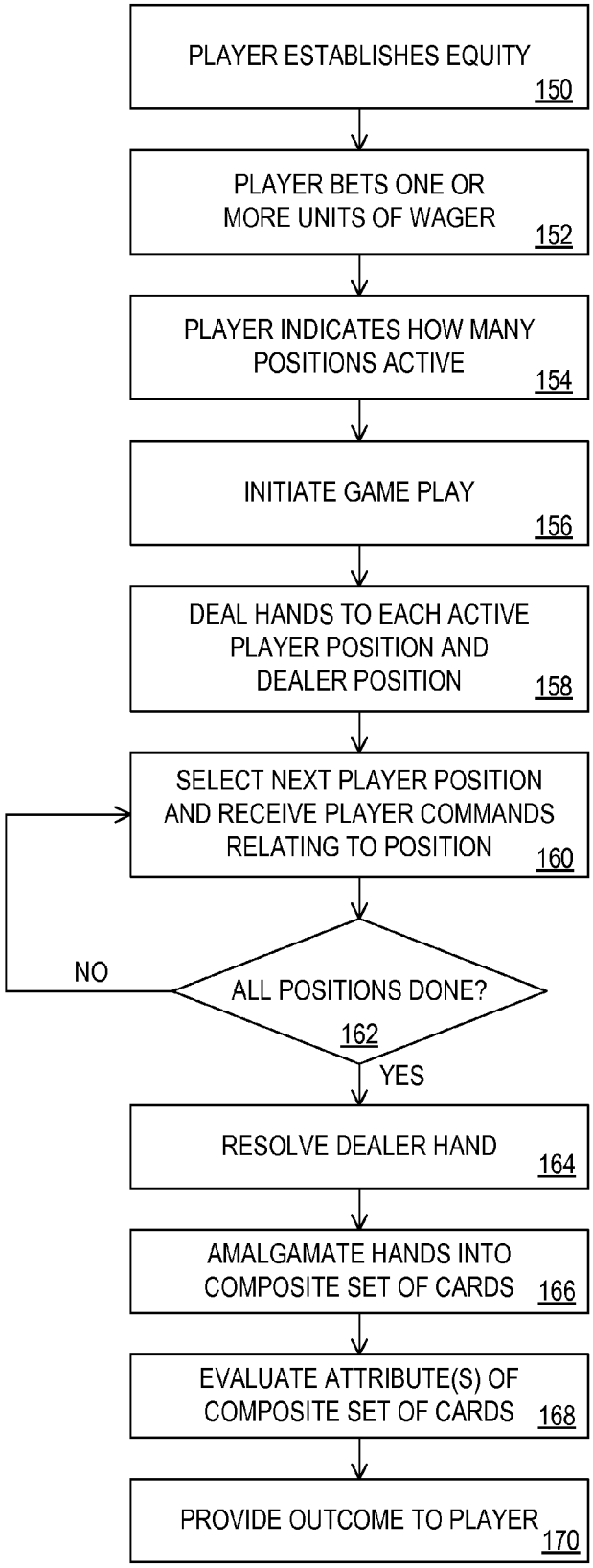
FIG. 6 illustrates a flow chart illustrating an exemplary methodology of certain embodiments of the present invention.

Against this backdrop of hardware components, particularly contemplated embodiments of the present invention are now presented. An exemplary method is set forth with reference to FIG. 6. FIG. 6 specifically contemplates use of a gaming device 10. A tabletop embodiment methodology is presented with reference to FIG. 11.

Initially, the player establishes equity with the gaming device 10 (block 150). As described above, the player may establish the equity through any appropriate mechanism such as inserting cash into the bill acceptor 48. Establishing equity will cause the credit meter 22 to increment to an appropriate number based on the units of wager associated with the gaming device 10.

The player bets one or more units of wager (block 152). The player may do this by pressing a credit wager button 38 corresponding to the desired unit of wager bet. The player indicates how many player positions 32 the player desires (block 154). The player may do this by pressing the position selection button 36 corresponding to the desired number of active positions. The player may then initiate game play (block 156) by pressing the start button 40 or pulling the handle 42.

The control system of the gaming device 10 then causes the primary display 16 to show cards being dealt such that hands are dealt to each active player position 32 and the dealer position 30 (block 158). The random number generator 56 may determine a random number, and the controller 54 access a look up table to determine a card's rank and suit corresponding to the determined random number. In an exemplary embodiment, a single virtual deck may be used, and duplicative random numbers results in a new random number being generated such that a card may not be repeated in any position. In a second embodiment, multiple virtual decks (e.g., two, four, six, infinite) may be used so that a particular card may appear more than once, up to the number of times that there are virtual decks in the virtual shoe being used to deal the cards.

Figure 7:
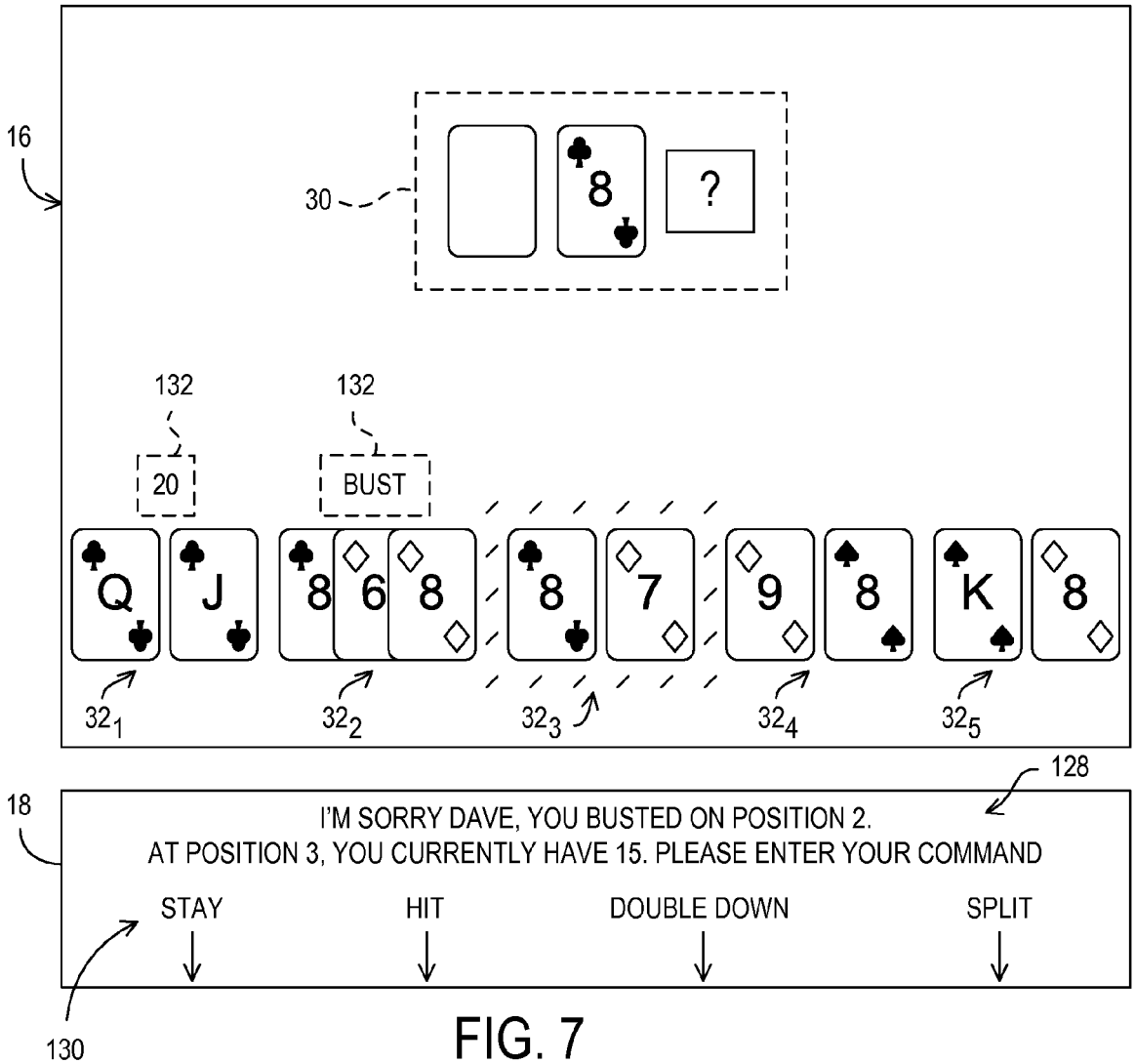
FIG. 7 illustrates a first exemplary screen shot of a portion of the methodology of FIG. 6.

The control system then selects the next active player position 32 and receives player commands relating to that position (block 160). For example, initially, the control system selects the first active player position $\mathbf{32}_1$ and receives commands such as hit, stay, double down, or the like from the player for the player position $\mathbf{32}_1$. Once the player is done with the position, the control system queries whether all active player positions 32 have been resolved (block 162). If not, the process repeats. For example, as illustrated in FIG. 7, which has exemplary screen shots for primary display 16 and secondary display 18, the player, "Dave" has just hit and busted at second position $\mathbf{32}_2$. Play action has moved to the third position $\mathbf{32}_3$, which may be presented in such a manner so as to highlight its status as the active player position 32. Exemplary presentations include, but are not limited to: blinking, a flashing border, a different color, or the like. Likewise, the secondary display 18 includes text 128 that describes recent events. In particular, for this example, the text 128 indicates that the second position busted, recites the current point total for the third position and requests that the player enter a command to continue play. Suggestive command indicia 130 are also presented directing the player's attention to corresponding play command buttons 34.

To further facilitate player understanding of events within the game, the primary display 16 may provide status indicia 132 at each finished player position 32 indicating the status of the hand at that particular player position. In the illustrated example, first player position $\mathbf{32}_1$ has status indicia reciting "20", which is the point total for that position. The second player position $\mathbf{32}_2$ has status indicia reciting "bust". Different status indicia 132 may be presented differently to highlight the differences. For example, busted hands may have differently colored indicia 132 than non-busted hands. Likewise, "soft" hands (featuring an Ace) might have differently colored indicia 132 than "hard" hands (without an Ace). Flashing lights or blinking values may also be displayed as practical or desired. Once all active player positions 32 have been resolved, the control system resolves the dealer hand (block 164). The dealer hand may follow published rules (e.g., dealer always hits on a soft seventeen or lower).

Figure 8:
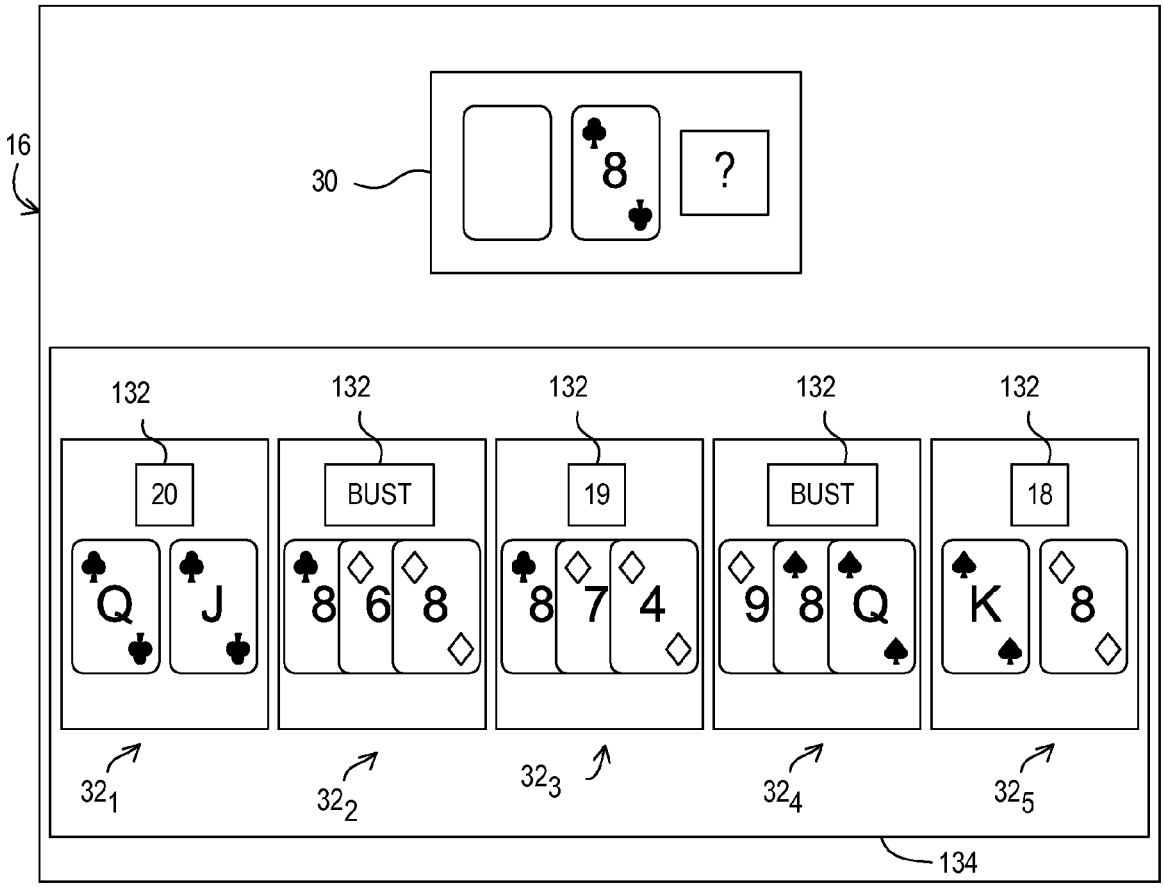
FIG. 8 illustrates a second exemplary screen shot of a portion of the methodology of FIG. 6.

The control system then amalgamates each of the hands at each of the active player positions 32 into a composite set of cards (block 166). As used herein, the act of amalgamating each of the hands at each of the active player positions 32 is meant to describe the process of creating a composite set of cards without vitiating the identity of the individual hands. In effect, the amalgamation process is a metaphorical box drawing exercise as illustrated in FIG. 8. As illustrated, each hand within each player position 32 has its own respective box drawn therearound. The amalgamation process draws a metaphorical box 134 around all the player positions 32 to create the composite set of cards made from the cards within each player position 32. Within the composite set of cards, various subsets of cards also exist. One readily apparent subset of cards is the individual hands from each of the active player positions 32. Other subsets may be defined as practical or desired.

The control system then evaluates one or more attributes of the composite set of cards (block 168) to determine an outcome. If the composite set of cards has a specific attribute, or an attribute exceeds a predefined threshold, then the outcome may be a benefit, and the benefit may be provided to the player. Regardless of whether the outcome is a benefit or a loss, the control system communicates or otherwise provides the outcome to the player (block 170). Note that as used herein, the term "outcome" includes winning and losing outcomes. Winning outcomes are usually associated with a benefit. A benefit may be a payout in the form of credits, comp points, or other value. As used herein the steps taken from the time initiation of game play to the provision of the outcome (including disbursing a benefit if applicable) constitutes a "round of game play". To the extent that the wager and number of active positions may vary from round to round, selection of these variables may also be included within a "round of game play".

Exemplary attributes which may be evaluated include, but are not limited to: number of hands within the composite set that beat a dealer hand, number of hands within the composite set that tie the dealer hand, number of hands that exceed a predetermined point total threshold (e.g., number of hands above seventeen that do not bust), number of blackjacks, number of total points by which the dealer is beat, a poker hand assembled from within the composite set of cards, number of cards within the composite set that are of a certain suit, number of cards within the composite set that are of a certain rank, total number of cards dealt to the player in the composite set, number of hands that are busts, number of hands that are not busts, total value of the composite set, number of hands that lose to the dealer hand, number of hands that beat the dealer's hand by a predetermined margin, a combination of one or more other attributes, and the like as practical or desired. While these attributes are all based on the composite set of the player's composite set of hands, it is also possible to determine and evaluate attributes of the dealer's hand and base outcomes thereon. For example, a benefit may be awarded to the player if the dealer busts, if the dealer hand has a point value above a predefined threshold, if the dealer hand has two or more cards from the same suit, or the like.

It is also contemplated that the control system may determine if attributes of the individual hands exceed a predefined threshold before determining the attributes of the composite set of cards. For example, the player may need to beat the dealer's hand by a combined total of three points to qualify for a prize according to the payout table. Such gatekeeping thresholds are optional and may be varied as practical or desired. However, the presence of such gatekeeping thresholds may cause the player to modify strategies for later player positions so as to make sure that the gatekeeping threshold is satisfied.

To facilitate understanding, a third exemplary screen shot is presented in FIG. 9. In particular, the secondary display 18 recites the various attributes of the composite set of cards and further recites what the payout for that attribute is. Note that attributes may be based on individual hands within the composite set or on other subsets of cards as practical or desired. In particular, the player has two hands that beat the dealer. According to the paytable set forth in FIG. 1, this fact is worth one credit for a single unit of wager. As is readily apparent from the example, a single round of game play may award multiple benefits as part of the outcome. Note that this exemplary screen shot would also meet the exemplary gatekeeping threshold since the individual hands have beat the dealer by at least three points. (20−18=2; 19−18=1; 2+1=3).

Because it may be confusing to a player which attributes are winning attributes, explanatory text 136 may be provided on the secondary display 18. Alternatively, a total value may be provided and the player given an opportunity to query the gaming device 10 for a more detailed explanation, in which case such an explanation may then be provided. As noted in FIG. 9, not only is the outcome provided to the player, but also the benefit is added to the player's equity with the gaming device 10 and the credit meter is changed to reflect the new balance.

While the paytable may be displayed on belly glass paytable display 28, the paytable may also be stored in memory 60, memory 74, or other location such that the control system may access the paytable and make the determinations described above as practical or desired. In constructing the paytable, it is possible to assume perfect play and determine a statistical probability of each event from which an expected value may be derived. This expected value may be combined with a wager amount and a desired house edge to provide appropriate values for the benefits.

A variation on the embodiment described in FIG. 6 is to fix the number of active player positions 32. That is, rather than let the player decide how many positions 32 to play, a set number of player positions 32 are always active. As another embodiment, the player may set the number of player positions 32 at the time of establishing equity and not vary the number during the gaming session. As still another embodiment, the player may select a desired number of active player positions 32 and store this information in the player's profile. Then, when the player is identified through the player-tracking program, the prestored information is accessed and implemented. Still other options are possible if practical or desired. It should be understood that, in some embodiments, the display 16 may accommodate a large number of player positions 32 (e.g., up to fifty or one hundred hands of cards).

As described, while outcomes may be dictated based on the number of hands that beat, tie, or lose to the dealer, and separate benefits may provided for each circumstance, it should further be appreciated that the player may make a side bet for a given player position. This side bet may be resolved according to a traditional blackjack rules set. For example, a blackjack may pay 3:2 and a hand that beats the dealer pays even money. Thus, in addition to the wager the player makes using the units of wager, the player may make one or more additional wagers using units of wager, fractional units of wager, or the like to bet that an individual hand will beat the dealer's hand. One way in which this side bet may be enabled is through the use of a virtual betting circle on a touch screen display 16. A popup menu may ask how many credits are being wagered. Other techniques, such as additional buttons in the input keypad 20, may also be used if practical or desired.

In still another embodiment, the player may request (or may automatically be provided) automated strategy instructions. For example, a strategy guide that recites a strategy for "perfect play" may appear each time requested by the player. This request may be effectuated through a button on input keypad 20, a virtual button as part of a touch screen display or otherwise as practical or desired.

As another variation, to speed game play, the gaming device 10 may offer automated play. The player sets parameters such as the number of active hands, the number of units of wager to be bet each round, and the like, and the gaming device 10 executes all play decisions about whether to hit/double down/split/stay. In a first embodiment, these decisions are programmed by the player. This programming may be done before game play truly starts. The programming may be done through a user interface, perhaps in a peripheral device having a keyboard and may be as simple as filling in a strategy chart such as that illustrated in FIG. 10 (note that the chart would start empty and the player may type in his desired instructions until the chart is filled in as presented in FIG. 10). As another option, the player may select an option such as hit all hands until seventeen is reached or match dealer's rules which causes the player's hands to be played as if according to the house rules. Still other rules may be implemented such as "always split on a pair of nines" or "always double down when my first two cards total a 'hard eleven'". Alternatively, the process may be iterative such that as each situation arises during game play, the player is queried for a decision. Thus, the player will spend the first several hands teaching the gaming device 10 to play making the decisions that the player would make, and then as each situation is encountered and the decision entered by the player, the player would receive fewer and fewer inquiries and game play would be automated. As still another option, the gaming device 10 may preemptively provide a "perfect play" strategy option for automated play such as that illustrated in FIG. 10. Note that what is illustrated in FIG. 10 is one exemplary perfect play strategy. Other perfect play strategies exist for other forms of blackjack (e.g., varying the numbers of decks varies the strategy; the presence of the surrender option varies the strategies; varying the rule on whether the dealer hits on a soft seventeen varies the strategies; etc.). As still another option, the player may automate play on player positions $\mathbf{32}_2$-$\mathbf{32}_5$ and manually play the first player position $\mathbf{32}_1$. Extending this concept, the player position 32 that the player actually plays may be varied. Likewise, the number of automated versus manual player positions may be varied as practical or desired by the player or the gaming device 10. For example, the player may manually play positions $\mathbf{32}_2$, $\mathbf{32}_3$, and $\mathbf{32}_5$ and have the gaming device 10 automatically play positions $\mathbf{32}_1$ and $\mathbf{32}_4$. In all automated play options, a button may be provided in input keypad 20 that effectuates an automated play command. For example, a button labeled "Decide for me" may be provided to begin a perfect play sequence.

For a tabletop game, the process is illustrated with reference to FIG. 11. The process starts as the player arrives at the table 96 and purchases chips from the dealer (block 200). Note that it is possible that the player arrives with chips having been purchased at a cashier's cage, another table, or the like.

The player places one or more chips in bet location 106 (block 202). This step is analogous to block 152 for the electronic version. However, the use of chips and the table environment makes the unit of wager more flexible. The value of the chips put into the bet location 106 may dictate how many hand locations 102 are active. Alternatively, all hand locations within the player station may be active as a default. In still other embodiments, the player may indicate through some other mechanism which and how many hand locations 102 are active. The dealer then deals hands to each active hand location 102 and the dealer hand location 116 (block 204).

In the manner of more traditional blackjack games, each active hand location 102 is resolved (block 206). Such resolution involves the player making decisions whether to stand, hit, double down, surrender (if available), and/or split. Once the active hand locations 102 are resolved, the dealer hand location 116 is resolved (block 208). Resolution of the dealer hand location 116 may be resolved through appropriate house rules (e.g., the dealer hits on a soft seventeen or less).

Each player's hands are amalgamated into a composite set of cards (block 210). Again, the identity of each individual hand may be preserved, and the amalgamation may more properly be thought of as drawing a mental box around all the cards for the player. The attributes of the composite set of cards are then evaluated (block 212). In a first embodiment, the evaluation is performed by the dealer. In a second embodiment, the evaluation is performed by some other gaming establishment personnel such as a floorman, pit boss, or the like. Reference may be made to the indicia presented on the payout table 122 to consider the various attributes of the composite set of cards. The player is then informed of the outcome (block 214), whether it be winning or losing. If the outcome is a losing outcome, the dealer collects the chips wagered by the player, adding them to the chip rack 114. If the outcome is a winning outcome, the dealer provides chips from the chip rack 114 corresponding to the amount won by the player. Alternatively, the dealer may provide a benefit through any other appropriate mechanism (e.g., adding an entry to the player-tracking record of the player to increase comp point totals or the like).

Figure 11:
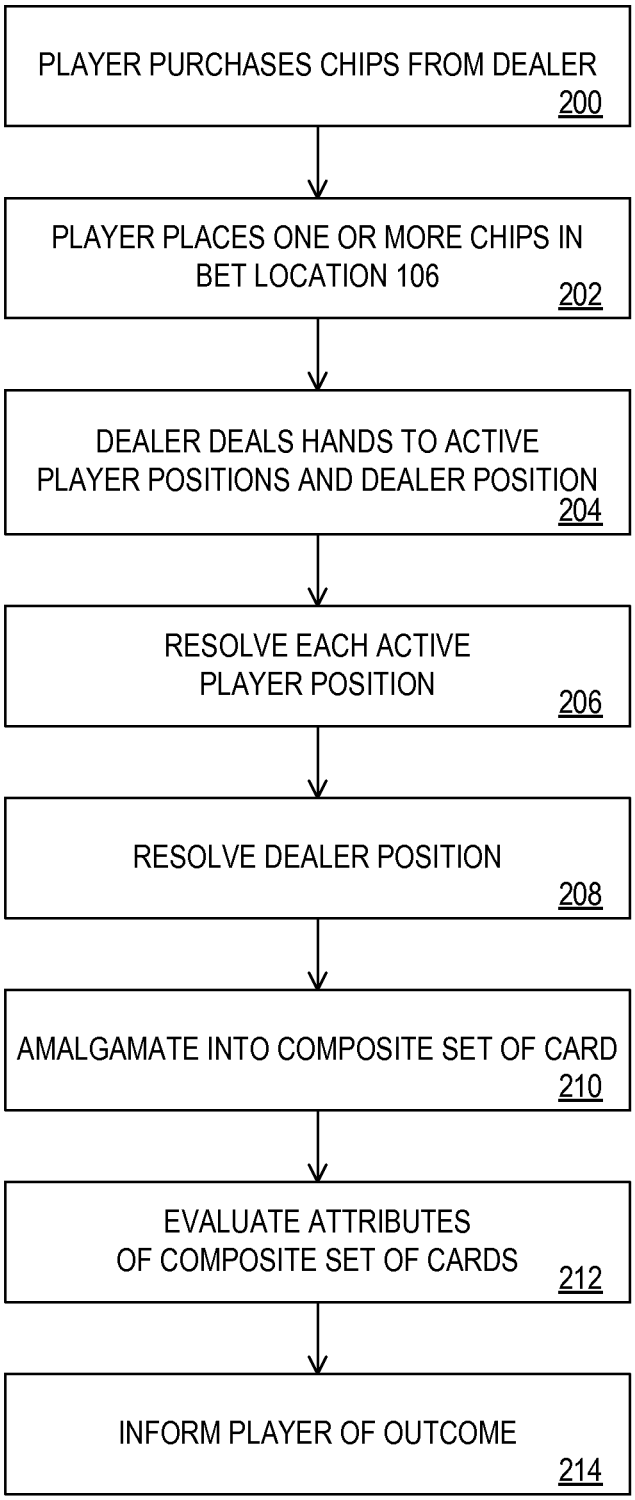
FIG. 11 illustrates an exemplary methodology for a tabletop embodiment of the present invention.

In the embodiment of FIG. 11, each player operates independently of the other. However, variations do exist that allow cooperative play after a fashion. For example, if the optional buddy bet location 108 is present, a player may place one or more chips in the buddy bet location 108. If this bet is present and enabled through the player placing such a bet, then a second composite set of cards is formed that includes not only the betting player's hands, but also the hands of any other player at the table 96. The attributes of this composite superset of cards are then evaluated and/or compared to the dealer hand and an outcome determined. Note that the value of benefits received may scale as more players participate in the "gang up on the dealer" bet. That is, much like increasing the number of units of wager wagered in the electronic game, if two players participate in the buddy bet option, the value of the payouts for each player may double. Three players participating may cause the value of the payouts to triple, and so forth.

Note that while in FIG. 5, each player 100 has three hand locations 102, it is also possible that each player 100 may have only one hand location 102 and thus, each hand location 102 has its own respective optional buddy bet location 108 (not shown). For example, the optional buddy bet location 108 may be added to a conventional blackjack table, one for each player chair and the amalgamation be made across the plurality of hands dealt to the various players.

Note further that this buddy play option may be introduced in the electronic version of the game if the gaming devices 10 are networked through the server 66. A button may be added to the housing 12 that allows the player to participate in this option and the composite superset of cards is formed across multiple gaming devices 10.

Note further that much like the player can make side bets on the individual hands in the electronic version, the presence of the optional individual hand wager location 110 allows the player to place similar side bets for the tabletop version of the game. Also, while not central to either embodiment, if the player is allowed to bet on the individual hands, traditional blackjack insurance may be offered for those wagers. Likewise, insurance could be provided for the gaming session. For example, commonly owned U.S. Pat. No. 6,113,463, which is hereby incorporated by reference in its entirety teaches how to sell gambling insurance. The techniques described therein could be applied to the slot machines and table games described herein. Other forms of insurance could be provided if practical or desired.

In both the electronic and tabletop versions, the number of dealer hands may also be varied. For example, each active player hand may be played against its own corresponding dealer hand. In this embodiment, the attributes on which payouts are based may be based on the number of times the dealer busts, the number of dealer blackjacks, or the like as practical or desired.

In both the electronic and tabletop versions, the number of decks may be varied. Greater latitude exists in the electronic version, because in that embodiment, an infinite number of decks may be used. A variation of this concept is varying how many shoes (virtual or real shoe 118) are present. In a first embodiment, a single shoe deals cards to all player positions and the dealer positions. In a second embodiment, each player position has its own shoe from which cards are dealt. Varying the number of shoes effectively further varies the number of decks used in the game. In a first embodiment, the player may select how many shoes and how many decks are in each shoe. In a second embodiment, the player may select only one of these parameters. In a third embodiment, the player may not select either parameter, but rather the parameters are set by the gaming device 10. The third embodiment has two variations, namely the parameters may be set for all game play, or the parameters may be varied for different game plays. Varying the parameters may be done randomly or according to a predefined schedule. Further varying the parameters may be done once per game session, once per round of game play, or randomly. For the sake of player happiness, the rules of such variations may be presented and explained to the player. In a further embodiment, player consent may be required before changing the parameters.

The order in which the cards are dealt may also be varied. While the exemplary methods presented in FIGS. 6 and 11 contemplate two cards being dealt to each player position 32 or hand location 102 and then to the dealer position 30 or dealer hand position 116 before resolving any particular player hand, it is also possible to deal cards to the first player position $\mathbf{32}_1$, resolve that hand, and then deal cards to the second player position $\mathbf{32}_2$, resolve the second player position and so forth. Dealing to multiple hands may occur substantially simultaneously. The dealer hand may be dealt and resolved at any time in this process. As still a further variation, limitations may be imposed such that the second player position is only activated if the first player position achieves a win or a push. As yet another variation the player may be offered the opportunity to take any winnings earned during resolution of the first player position or continue on into the second player position, but with an added risk of losing all her winnings in a manner similar to a "Press Your Luck" style of game.

As still another variation, a player may be required to make the same decision for all hands. For example, the player makes one decision to hit or stand, and that decision applies to each active player position. This rule has the benefit of speeding up game play and forcing the player to make more global decisions about the composite set of cards.

As yet another variation, the player may select the value of the dealer hand before the round of game play begins. For example, the player can select a dealer hand value of seventeen through twenty-one. As this will affect the likelihood of the player beating the dealer hand (as well as eliminate any dealer bust payout options), the paytable may be varied accordingly (e.g., a player may win more for beating the dealer three times if the dealer's hand is set at twenty than if the dealer's hand is set at seventeen).

As still another variation, the player may wager that one or more hands will not beat the dealer. An example of this concept applied to slot machines is set forth in commonly owned U.S. Pat. No. 6,113,492, which is hereby incorporated by reference in its entirety. This wager may be made as a side bet, or the entire paytable may be toggled between winning or losing hands as practical or desired.

As another variation, a round may comprise multiple dealer hands. For example, a "five on two" round might compare fiver player hands individually against two distinct dealer hands (allowing ten player-versus-dealer comparisons in the round). In another example, a single player hand may be compared to multiple dealer hands (e.g., players get paid more for defeating more dealer hands within a single round).

As yet another variation, the starting hand of the player may be replicated across multiple player positions. Players may then elect to make similar or different play decisions as the player will randomly receive different additional cards for each hand. This may encourage a player to play aggressively with one hand and conservatively with another. A further variation on this concept is that this concept may be offered only when a player doubles down. Another extension of this concept is providing the same initial hand to the dealer.

As another variation, game play may be offered as part of a package. Such packages may include certain amounts of guaranteed play (e.g., a session of twenty-five rounds of five positions of cards), combined with show or meal tickets, hotel room rates, airline travel discounts, and the like.

As still another variation, the game may take into account a "bad beat" and offer payouts for such events. For example, the paytable may contemplate that a player loses a plurality of hands by a slim margin (e.g., the player has three nineteen point hands and the dealer has a twenty point hand). Another example of a bad beat is an improbable bust (e.g., the player has a twelve and the dealer's upcard is a six. The player hits and pulls a ten, busting the player). Other bad beats may be defined and benefits granted for such occurrences so as to numb the pain of nearly winning. Note that such bad beat payouts may be offered as insurance in place of more traditional insurance packages.

As yet another variation, perhaps better suited for the electronic embodiment, a card counting feature may be provided that informs the player when a virtual deck or virtual shoe is rich in cards with a value of ten points. This variation may be offered as part of a package or other premium play options.

As another variation, the control system may track a player's play decisions relative to a perfect play strategy. This tracking may be done for fraud detection or for other reasons and may be shared with the player if desired. The information may be shared with the player in the form of a meter or bar graph showing the percentage of "correct" decisions according to a perfect play strategy. Alternatively, after a decision is made, the animations associated with that decision may be highlighted in green or red to show that it was the correct or incorrect decision. Still other techniques for providing this information may be used if practical or desired.

In another variation, the player may request a shuffle of a virtual deck or shoe of cards. This request may be made through an appropriate input device in the user interface 50. In such a circumstance, animations may be provided to show the cards being shuffled and the random number generator may be reseeded. If the order of the cards in the virtual shoe has been determined, the random number generator may be used to determine a new order. This option may be awarded as a benefit or selectively available after a player has initiated a predetermined number of rounds of game play. Alternatively, this option may be available whenever desired by a player.

In still another variation, the player may trade cards between different player positions to maximize potential benefits awarded. Thus, for example, players may trade cards to reduce the likelihood that a particular hand may bust, improve the odds for a hand which will be subjected to a double down or the like. Availability of this option may be contingent on another factor. For example, the player may pay a premium (cash value, comp points, or the like) each time the player wishes to exchange a card. Alternatively, the player may have a certain number of trades allowed per round of game play, per unit of wager, or the like. For example, a player may be awarded one tenth of a trade per each unit of wager bet by the player. Then after the player had bet ten units of wager (regardless of how many rounds of game play that took), the player would be entitled to a trade. The right to trade a card may be awarded to the player through the random appearance of a "trade" card. That is, a card similar to the joker may be left in the decks, and if that card is dealt to the player, then the player is entitled to redeem that card for a trade. Still other techniques for awarding or limiting trades may be implemented.

As a further variation, the nature of what is wagered and awarded as a benefit may be varied. For example, the player may wager chips or credits having a cash value and be awarded comp points or other prizes instead of credits or chips. A variation on this would be to allow the player to wager comp points or other alternate currency element and be awarded credits or chips for winning outcomes. If side bets are allowed, this variation may be extended such that similar substitutions take place in both the base game and the side bet, or as another embodiment, normal wagering occurs in either the base game or the side bet and the alternate wager/benefit occurs in the other. As should be appreciated, such wagering and benefit formats may be varied to suit the needs of the gaming establishment and the demands of the players.

While the disclosure has focused on blackjack, it is possible to extend these concepts to other games. For example, a reel-based slot machine may be used in which case the player may spin a plurality of sets of reels substantially concurrently as part of a single round of game play and one or more virtual "opponent" set of reels are spun. The player is paid based on how many of the player's sets of reels achieve a better result than the opponent's set(s) of reels. The "better result" may be based on a conventional paytable associated with that particular set of reels (e.g., it is generally known that three cherries is a better result than a single cherry for a fruit slot machine). Likewise, the game may be extended to a video poker embodiment. The player receives a plurality of substantially concurrent hands of draw video poker and the player is paid based on attributes of the composite set of cards created from the player's plurality of hands. Other games such as Keno and baccarat could also be used. These examples are intended to be exemplary and non-limiting as those skilled in the art will readily perceive how to adapt other games to this concept.

Rules of Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

A player "wagers" at least a single "unit of wager" to pay for a game start. In many gaming devices, a unit of wager may be referred to as a credit. Many gaming devices allow multiple credits to be wagered concurrently in exchange for an improved paytable or more paylines. A unit of wager may be equivalent to a full dollar amount ($1, $5), a fractional dollar amount, a coin (e.g., $0.05 (nickel) or $0.25 (quarter)), or specified amount of another currency (e.g., a specified number of comp points). Some paytables may be expressed as a number of coins won relative to a number of coins wagered. In such instances, the term coin is the same as a unit of wager. Because gaming devices are embodied in different denominations, it is relevant to note that a coin, credit, or unit of wager on a first device may not be identically valued as a coin, credit, or unit of wager on a second device. For example, a credit on a quarter slot machine (on which the credit is equivalent to $0.25) is not the same as a credit on a five dollar slot machine (on which the credit is equivalent to $5.00). Accordingly, it should be understood that in embodiments in which a player may cash out credits from a first gaming device that operates based on a first denomination (e.g., a quarter-play slot machine) and establish, using only the cashed out credits, a credit balance on a second gaming device that operates based on a second denomination (e.g., a nickel-play slot machine), the player may receive a different number of credits on the second gaming device than the number of credits cashed out at the first gaming device.

"Determining" something can be performed in a variety of manners and therefore the term "determining" (and like terms) includes calculating, computing, deriving, looking up (e.g., in a table, database or data structure), ascertaining, recognizing, and the like.

The present disclosure frequently refers to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM or AMD ATHLON processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, TDMA, CDMA, GSM, EDGE, GPRS, WCDMA, AMPS, D-AMPS, IEEE 802.11 (WI-FI), IEEE 802.3, SAP, SAS™ by IGT, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such larg files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Devices in communication with each other need not be continually transmitting to each other. On the contrary, such computers and devices need only transmit to each other as necessary, and may actually refrain from exchanging data most of the time.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present disclosure, but may nevertheless be claimed in one or more continuing applications that claim the benefit of priority of the present disclosure.

What is claimed is:

1. A method of operating a gaming device, said method comprising:

for each play of a card game, causing at least one processor to execute a plurality of instructions stored in at least one memory device to:

(a) operate with at least one display device to display a plurality of individual blackjack hands to a player, each of the displayed individual blackjack hands including an initial plurality of cards;

(b) operate with at least one input device to, for each of the displayed individual blackjack hands, enable the player to request at least one additional card to add to said displayed individual blackjack hand and add said at least one additional card to said displayed individual blackjack hand;

(c) for each of the displayed individual blackjack hands, form a final individual blackjack hand, said final individual blackjack hand including the initial plurality of cards of said displayed individual blackjack hand and any additional cards added to said displayed individual blackjack hand;

(d) after forming the final individual blackjack hands, designate a composite set of cards, said composite set of cards including at least one card from each of a plurality of the final individual blackjack hands;

(e) for each of the final individual blackjack hands, evaluate said final individual blackjack hand to determine whether to provide a first award to the player;

(f) evaluate the composite set of cards to determine whether to provide a second award to the player, said second award being in addition to any first awards provided to the player; and (g) if the at least one processor determines to provide any first awards or the second award to the player, cause said first awards or the second award to be provided to the player.

2. The method of claim 1, wherein causing the at least one processor to execute the plurality of instructions to evaluate the composite set of cards includes causing the at least one processor to execute the plurality of instructions to evaluate a subset of the composite set of cards, said subset including fewer cards than the composite set of cards.

3. The method of claim 2, wherein causing the at least one processor to execute the plurality of instructions to evaluate said subset comprises causing the at least one processor to execute the plurality of instructions to evaluate the cards of a quantity of the final individual blackjack hands less than the plurality of displayed individual blackjack hands.

4. The method of claim 1, wherein causing the at least one processor to execute the plurality of instructions to designate the composite set of cards includes causing the at least one processor to execute the plurality of instructions to amalgamate each of the final individual blackjack hands into the composite set of cards.

5. The method of claim 1, which includes causing the at least one processor to execute the plurality of instructions to operate with the at least one input device to accept a wager from the player, said wager being associated with said evaluation of the composite set of cards.

6. The method of claim 5, which includes, if the determination is not to provide the second award to the player, causing the at least one processor to execute the plurality of instructions to cause an indication that the player has lost the wager.

7. The method of claim 1, which includes causing the at least one processor to execute the plurality of instructions to operate with the at least one input device to accept an input from the player indicating a quantity of individual blackjack hands to be displayed.

8. The method of claim 7, wherein causing the at least one processor to execute the plurality of instructions to cause said first awards or the second award to be provided to the player includes causing the at least one processor to execute the plurality of instructions to provide a payout based at least in part on the quantity of individual blackjack hands displayed to the player.

9. The method of claim 1, wherein causing the at least one processor to execute the plurality of instructions to evaluate the composite set of cards comprises causing the at least one processor to execute the plurality of instructions to evaluate at least one of:

(a) a number of hands of the displayed individual blackjack hands that beat a dealer hand, (b) a number of hands of the displayed individual blackjack hands that tie the dealer hand, (c) a number of hands of the displayed individual blackjack hands that exceed a predetermined point total threshold, (d) a number of blackjacks, (e) a number of points by which the dealer hand is beat, (e) a poker hand assembled from within the composite set of cards, (f) a number of cards within the composite set of cards that are of a certain suit, (g) a number of cards within the composite set of cards that are of a certain rank, (h) a total number of cards in the composite set of cards, (i) a number of hands of the displayed individual blackjack hands that are busts, (j) a number of hands of the displayed individual blackjack hands that are not busts, (k) a total value of the composite set of cards, (l) a number of hands of the displayed individual blackjack hands that lose to the dealer hand, and (m) a number of hands of the displayed individual blackjack hands that beat the dealer hand by a predetermined margin.

10. The method of claim 1, which includes causing the at least one processor to execute the plurality of instructions to provide a paytable to the player, said paytable describing winning events and awards associated therewith.

* * * * *